US008113130B2

(12) United States Patent
Leng

(10) Patent No.: US 8,113,130 B2
(45) Date of Patent: Feb. 14, 2012

(54) FOLDING ASSEMBLY AND FOLDAWAY TABLE

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 313 days.

(21) Appl. No.: 12/520,906

(22) PCT Filed: Feb. 3, 2008

(86) PCT No.: PCT/CN2008/000281

§ 371 (c)(1),
(2), (4) Date: Jun. 23, 2009

(87) PCT Pub. No.: WO2008/098476

PCT Pub. Date: Aug. 21, 2008

(65) Prior Publication Data

US 2009/0293779 A1 Dec. 3, 2009

(30) Foreign Application Priority Data

Feb. 15, 2007 (CN) ..... 2007 1 0008635

(51) Int. Cl.
*A47B 3/00* (2006.01)

(52) U.S. Cl. ..... 108/133; 108/132; 248/439

(58) Field of Classification Search ..... 108/117, 108/120, 129, 131–133; 248/166, 439
See application file for complete search history.

(56) References Cited

U.S. PATENT DOCUMENTS

| | | | | | |
|---|---|---|---|---|---|
| 49,500 | A | * | 8/1865 | Carter, Jr. | 108/131 |
| 571,800 | A | * | 11/1896 | Rylander | 108/131 |
| 1,859,588 | A | * | 5/1932 | Kehrer | 108/132 |
| 1,872,833 | A | * | 8/1932 | Silverman | 108/132 |
| 2,089,318 | A | * | 8/1937 | Willson | 108/131 |
| 2,596,267 | A | * | 5/1952 | McKinnie | 108/117 |
| 2,671,974 | A | * | 3/1954 | McKinnie | 108/117 |

(Continued)

FOREIGN PATENT DOCUMENTS

CN 2564001 Y 8/2003

(Continued)

*Primary Examiner* — Hanh V Tran
(74) *Attorney, Agent, or Firm* — Rabin & Berdo, P.C.

(57) ABSTRACT

A folding mechanism for a folding table is described. The folding table includes a table top, a supporting portion and a leg portion with two legs and a fixing rod mounted between the two legs. The two legs form a rotatable connection with the table top. The supporting portion includes a supporting rod and a locking member. The locking member has a U-shaped sheet and a locking element disposed in the supporting rod. The U-shaped sheet includes a central vertical sheet and two side vertical sheets. The central vertical sheet and the two side vertical sheets are fixed to the fixing rod. The central vertical sheet has a sliding opening for accommodating the supporting rod so that the supporting rod rotates relative to the sliding opening during sliding. One end of the supporting rod is rotatably connected to a lower surface of the table top. The other end passes through the sliding opening. When the folding mechanism is in a locked position, the locking element in the supporting rod engages the two side vertical sheets of the U-shaped sheet fixed to the fixing rod.

6 Claims, 9 Drawing Sheets

U.S. PATENT DOCUMENTS

| | | | | |
|---|---|---|---|---|
| 3,072,451 | A * | 1/1963 | Greenberg et al. | 108/160 |
| 5,454,575 | A * | 10/1995 | Del Buono | 280/35 |
| 6,634,304 | B2 * | 10/2003 | Wang | 108/129 |
| 6,877,441 | B2 * | 4/2005 | Zheng | 108/130 |
| 2003/0121460 | A1 * | 7/2003 | Lou-Hao | 108/132 |
| 2005/0155533 | A1 * | 7/2005 | Lin et al. | 108/132 |
| 2006/0021552 | A1 | 2/2006 | Pleiman et al. | |

FOREIGN PATENT DOCUMENTS

| | | | |
|---|---|---|---|
| CN | 2762632 | Y | 3/2006 |
| CN | 2788644 | Y | 6/2006 |
| DE | 29920119 | U1 | 2/2000 |
| GB | 2382984 | A | 6/2003 |
| GB | 2398028 | A | 8/2004 |

* cited by examiner

A

B

C

FOLDING ASSEMBLY AND FOLDAWAY TABLE

FIELD OF THE INVENTION

The present invention relates to a folding mechanism and folding table of furniture.

BACKGROUND OF THE INVENTION

Folding mechanism of foldable table in the market, such as ZL02259585.6 issued in Aug. 6, 2003 in CNPAT comprises a table top, a leg portion and a supporting portion, the upper portion of legs formed rotatable connection with the table top, the supporting portion comprises a first pivotally connecting with the leg portion, a second pivotal-connection portion for pivotally connecting with the table top and a ring, the first pivotal-connection portion pivotally connected with the second pivotal-connection portion, the table top, the leg portion, the first pivotal-connection portion and the second pivotal-connection portion formed a four-rod folding mechanism, after being unfolded, the folding mechanism is fixed in a unfolded position by the ring which limit the rotation between the first pivotal-connection portion and the second pivotal-connection portion. However, the first pivotal-connection portion and the second pivotal-connection portion of the supporting portion of the folding mechanism can rotate relative to each other, thus the mechanism has a complicated structure, many rods, high cost, unstable when forced and unstable structure; locked by the ring after being unfolded make the locking unstable, accordingly, the table is unstable.

SUMMARY OF THE INVENTION

The primary object of the present invention is to provide a folding mechanism and folding table which obviate the problem aforementioned that the mechanism has disadvantages such as complicated structure, many rods, high cost, unstable when forced and unstable structure.

This object is achieved by providing: A folding mechanism comprising a table top, a leg portion, and a supporting portion, the top of said leg portion formed rotatable connection with said table top, wherein said supporting portion comprising at least a supporting rod and a locking member, said locking member connected to said leg portion, one end of said supporting rod rotatably connected to the lower surface of the tabled top and the other end connected to the locking member, wherein the supporting rod formed a rotatable and slidable connection with the supporting portion so that a folding mechanism is formed by the table top, leg portion and the supporting portion.

The position that the supporting rod relative to the locking member can be locked or released by said locking member.

Said locking member formed a rotatable connection to said leg portion, the other end of said supporting rod slidably pass through the locking member.

Said locking member comprises a sliding sleeve and a locking element, said sliding sleeve formed a rotatable connection with the leg portion, said supporting rod slidably pass through the sliding sleeve, and the position that the supporting rod relative to the locking member can be locked or released by said locking member.

Said locking element comprises an elastomer disposed in the supporting rod and a locking hole connecting the inner side and outer side of the sliding sleeve, said elastomer has a block which pass through the supporting rod and insert in the locking hole by the elasticity.

Said supporting portion further comprises a connecting portion, one end of said connecting portion pivotally connected to the leg portion and the other end fixedly connected to the locking member.

Said locking member comprises a sliding opening and a locking element, said sliding opening fixedly connected to the leg portion, said supporting rod pass through said sliding opening and rotate relatively in the sliding process, and the position that the supporting rod relative to the locking opening can be locked or released by said locking member.

This object is achieved by providing: A folding table comprising a table top, a leg portion, and a supporting portion, wherein the top of said leg portion formed rotatable connection with said table top, said supporting portion comprising at least a supporting rod and a locking member, said locking member connected to said leg portion, one end of said supporting rod rotatably connected to the lower surface of the tabled top and the other end connected to the locking member, wherein the supporting rod formed a rotatable and slidable connection to the supporting portion so that a folding mechanism is formed by the table top, leg portion and the supporting portion.

The position that the supporting rod relative to the locking member can be locked or released by said locking member.

Said locking member formed a rotatable connection to said leg portion, the other end of said supporting rod slidably pass through the locking member.

Said locking member comprises a sliding sleeve and a locking element, said sliding sleeve formed a rotatable connection with the leg portion, said supporting rod slidably pass through the sliding sleeve, and the position that the supporting rod relative to the locking member can be locked or released by said locking member.

Said locking element comprises an elastomer disposed in the supporting rod and a locking hole connecting the inner side and outer side of the sliding sleeve, said elastomer has a block which pass through the supporting rod and insert in the locking hole by the elasticity.

Said supporting portion further comprises a connecting portion, one end of said connecting portion pivotally connected to the leg portion and the other end fixedly connected to the locking member.

Said locking member comprises a sliding opening and a locking element, said sliding opening fixedly connected to the leg portion, said supporting rod pass through said sliding opening and rotate relatively in the sliding process, and the position that the supporting rod relative to the locking opening can be locked or released by said locking member.

In the present invention one end of said supporting rod rotatably connected to the lower surface of the tabled top and the other end connected to the locking member, wherein the supporting rod formed a rotatable and slidable connection to the supporting portion so that a folding mechanism is formed among the table top, leg portion and the supporting portion. Thus the problem in the background is obviated, and the present invention has the following advantages: simple structure, less rods, lower cost, more stable, rapid folding or unfolding process. The locking member formed rotatable connection to the leg portion, one end of the supporting rod pass through the locking member, thus a swing guiding rod mechanism formed between the table top, leg portion, supporting rod and locking member to fold or unfold. One end of the supporting rod rotatably connected to the lower portion of the table top, and the other end slidably pass through the locking member, the supporting rod and the locking member has a larger sliding distance relative to each other, thus the angle between the supporting rod and leg portion can be designed to a preferred angle for pressing, the moment arm can be designed to a most laborsaving moment arm, the unfolded folding mechanism has a high stable capability.

ILLUSTRATION FOR THE MAIN COMPONENTS

1 table top, 11 vacuum-molded plastic board, 12 cross beam,

13 central pivot, 14 pivot

2 leg, 21 fixing rod;

3 supporting portion, 31 locking member, supporting rod 32, 311 U-shaped sheet, 312 locking element, 3111 central vertical sheet, 3112 side vertical sheet, 3113 sliding opening, 3114 arc surface, 3115 locking hole, 3121 elastomer, 3122 block, 313 sliding sleeve, 33 connecting rod.

DETAILED DESCRIPTION OF THE PREFERRED EMBODIMENTS

Embodiment 1

Figure 1:
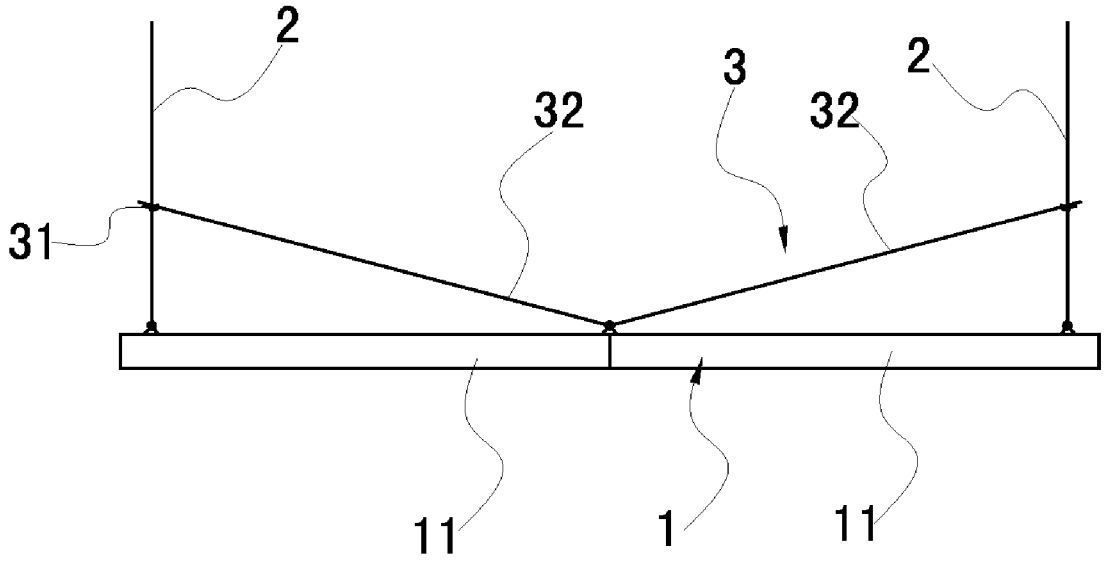
FIG. 1 illustrates the principle of the structure of the folding table in embodiment 1 of the present invention.
Figure 2:
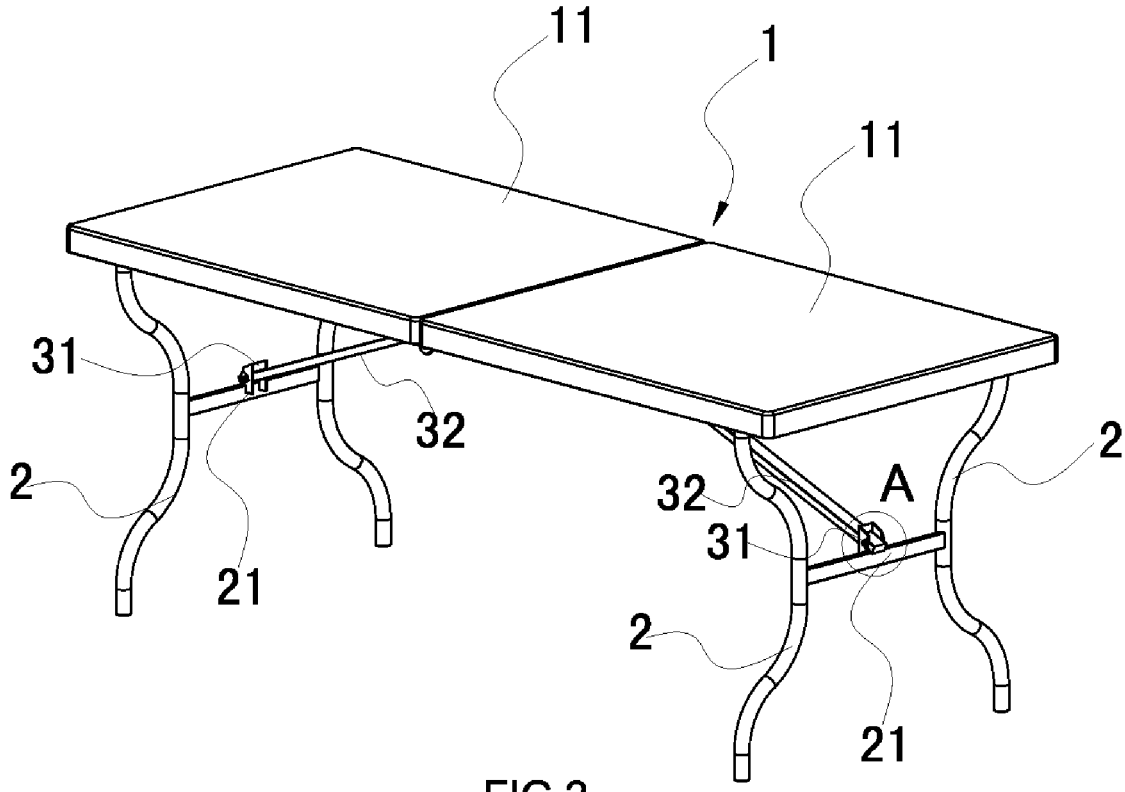
FIG. 2 is a perspective view of the folding table in an unfolded position in embodiment 1 of the present invention.
Figure 3:
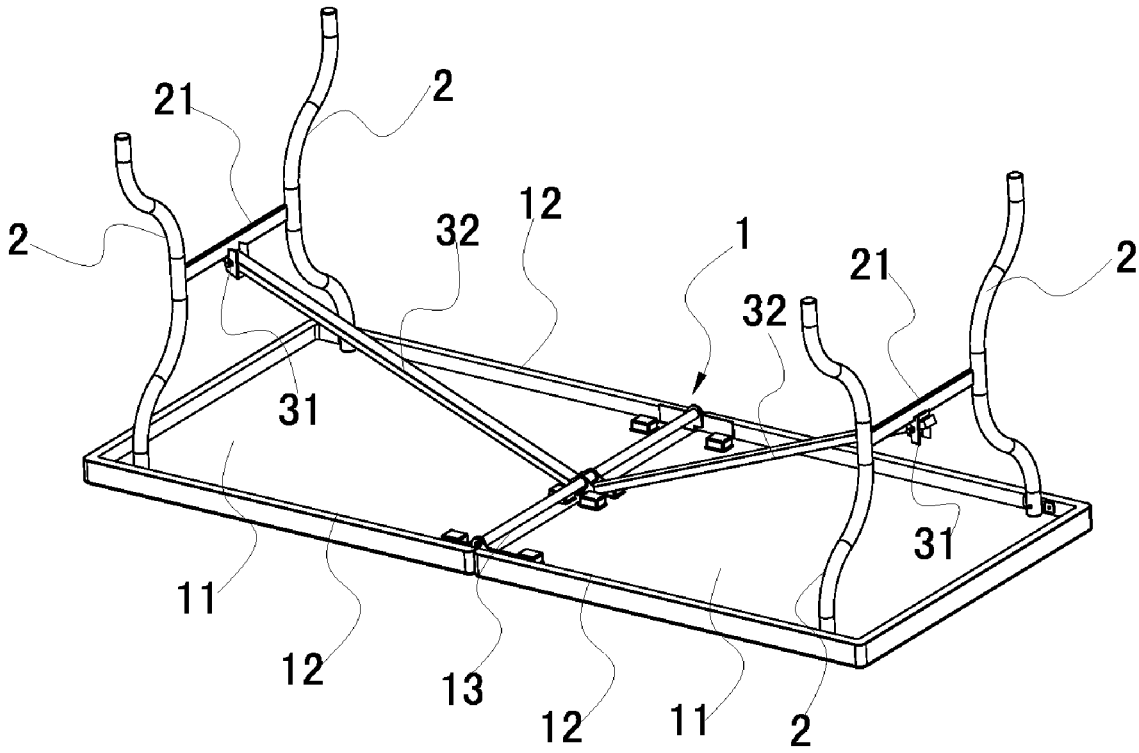
FIG. 3 is another perspective view of the folding table in an unfolded position in embodiment 1 of the present invention.

Referring to FIG. 1, FIG. 2 and FIG. 3, a folding table comprises a table top 1, four legs 2 and two supporting portion 3, the top of each leg 2 rotatably connected to the table top 1, the supporting portion 3 connected between the table top 1 and leg 2.

Figure 7:
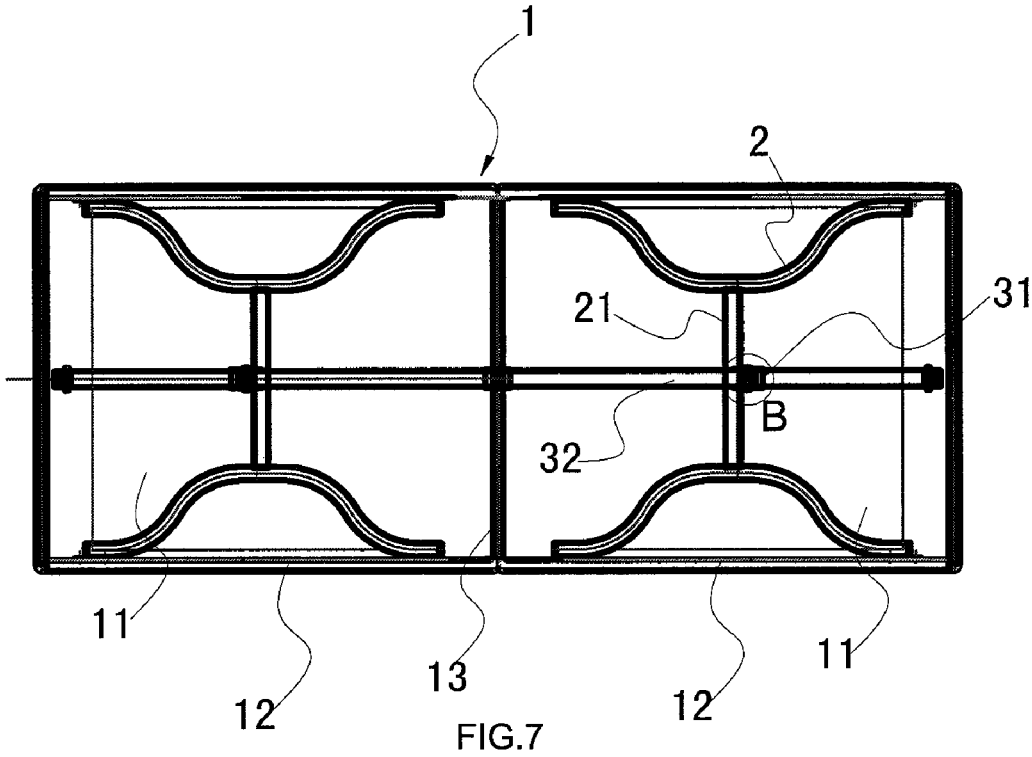
FIG. 7 is a sectional view of the folding table in a fully folded position in embodiment 1 of the present invention.

Referring to FIG. 3 and FIG. 7, the table top 1 comprises two vacuum molded boards 11 pivotally connected to each other by a central pivot 13 to let them can be folded in half. A clamping device is equipped for locking the position of the two vacuum-molded boards after being unfolded to let them be remained in a stable unfolded position. The vacuum-molded board comprising a plastic top plate, a plastic bottom plate, honeycombs, and lining, the top plate and the bottom plate fixedly adhered to the top and bottom of the honeycomb respectively, the lining sandwiched between the top plate and bottom plate and covering the honeycomb entirely or partially. The plastic top plate and the plastic bottom plate are all plastic composite plate manufactured by vacuum-molded board or extruded board, the plastic top plate and the plastic bottom plate can be single-layer or multiple-layer, the thickness of the plastic composite board is between 0.3 mm to 0.4 mm. The material consisted of the plastic composite board can be ABS, PP or PS etc. the surface of the plastic composite board is composited by a printing layer with various nature colors and texture such as wood grains or marble; or composited a film layer with various nature colors and texture such as wood grains or marble; then remove the film after transferring, and spray thermo curing or UV-curing varnish to reinforce the rigidity and weatherability of the surface. The superposition edges of the vacuum molded plastic bottom plate and plastic top plate connected to each other by welding or gluing, the superposition edges can be set in side or in bottom. The lining is a closed or U-shaped or H-shaped frame made by pipe fittings or profiles or hardware, or made by composite part consisted of pipe fittings or profiles or hardware or injection part, the lining is used for reinforcing the intension of the table top or connecting the other structure to reinforce the connecting intension to the other structure. Reinforce member embedded in the corner of the lining connected to the frame by clamping or screw thread or welding can reinforce the corner and act connecting function. Referring to FIG. 3, the plastic bottom plate and the lining of the plastic board cooperated to each other to form cross beam 12.

Referring to FIG. 3, in the four legs 2, two legs 2 pivotally connect to the two cross beam 12 of the plastic board 11 via two connecting sheet respectively, and a fixing rod 21 mounted between the two legs 2. The other two legs 2 pivotally connect to the two cross beam 12 of another plastic board 11 via two connecting sheet respectively, and a fixing rod 21 mounted between the two legs 2 also.

Figure 8:
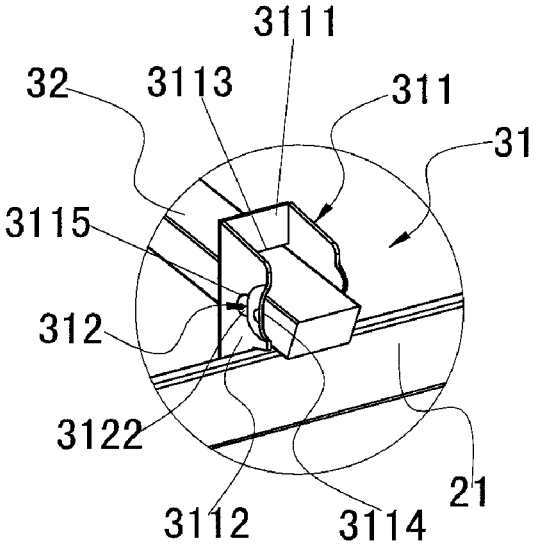
FIG. 8 is a partial enlarged view of A portion in FIG. 2.
Figure 9:
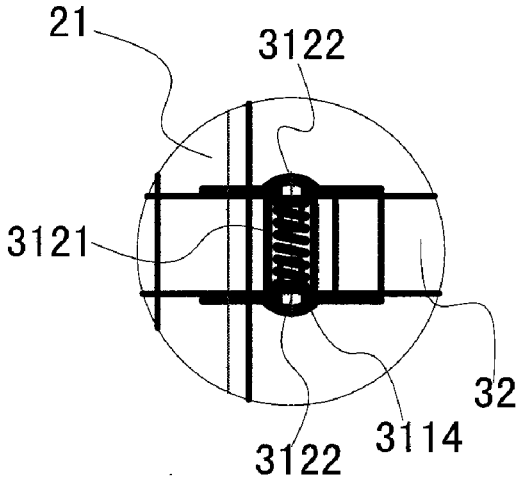
FIG. 9 is a partial enlarged view of B portion in FIG. 7.

Referring to FIG. 3, the supporting portion 3 comprises a supporting rod 32 and a locking member 31. The locking member 31 comprises a fixing portion, a U-shaped sheet 311 and a locking element 312, the fixing portion fixed with the fixing rod 21. Referring to FIG. 7, FIG. 8 and FIG. 9, the U-shaped sheet 311 comprises a central vertical sheet 3111 and two side vertical sheet 3112 symmetrically mounted in the two sides of central vertical sheet 3111, the central vertical sheet 3111 has a sliding opening 3113 which is a little larger than the section area of the supporting rod 32, the middle of the end of the side vertical sheet 3112 is protruded out to form an arc surface in the inner side of the side vertical sheet 3112 to have automatically locking function, and a locking hoe 3115 disposed in the side vertical sheet 3112, the locking hole 3115 is between the arc surface 3114 and the central vertical sheet 3111; the bottom of central vertical 3111 and the two side vertical sheet 3112 U-shaped sheet 311 are all fixed with fixing portion. The locking element 312 comprises an elastomer 3121 disposed in the supporting rod 32, each of the two ends of the elastomer has a block 3122, the block 3122 pass through the supporting rod 32 and insert into the locking hole 3115 to lock the locking member 31 with the supporting rod 32 in the action of elastomer force. Please referring to FIG. 3, FIG. 7, FIG. 8 and FIG. 9, one end of the supporting rod 32 pivotally connected to the central pivot 13, the other end pass through the sliding opening 3113 and can rotate relatively in the sliding process, when reach the position it will be locked by the locking element 312.

Figure 4:
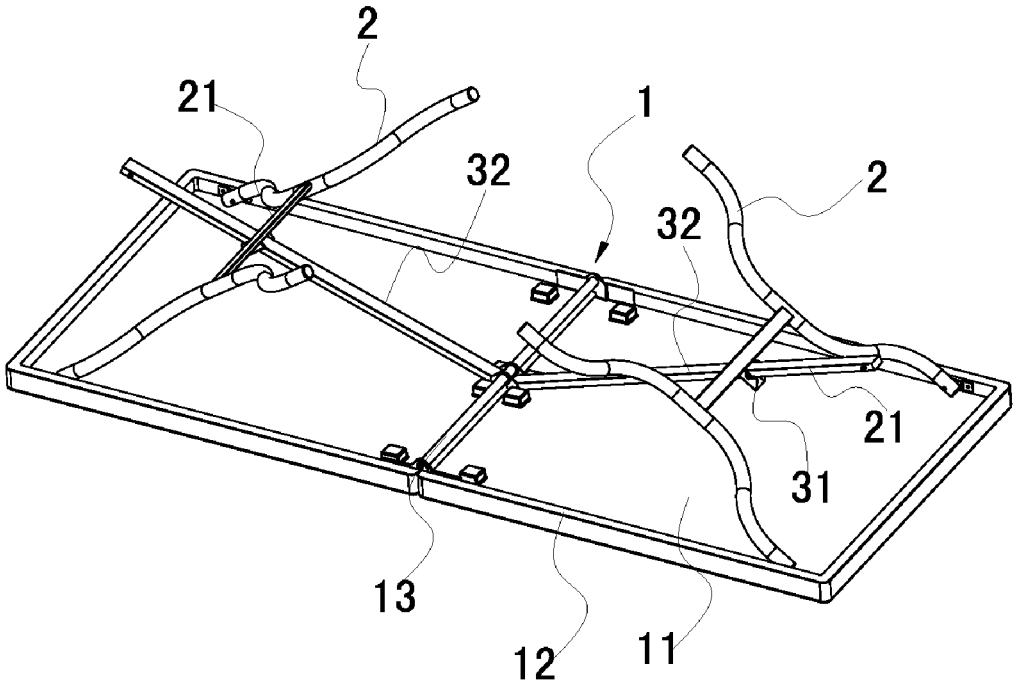
FIG. 4 is a perspective view of the folding table in a folding position in embodiment 1 of the present invention.
Figure 5:
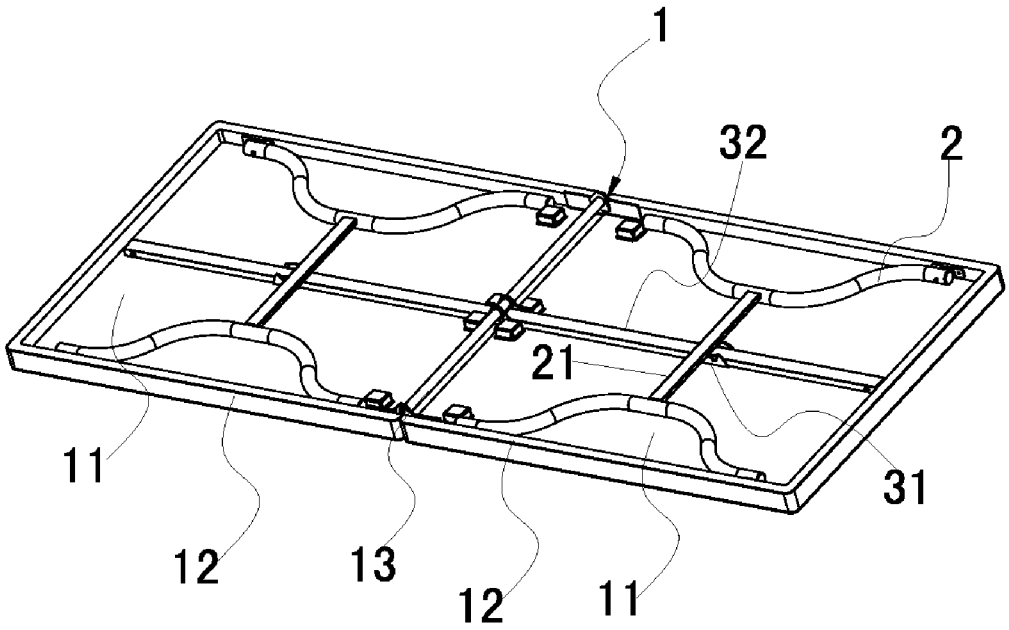
FIG. 5 is a perspective view of the folding table in another folding position in embodiment 1 of the present invention.
Figure 6:
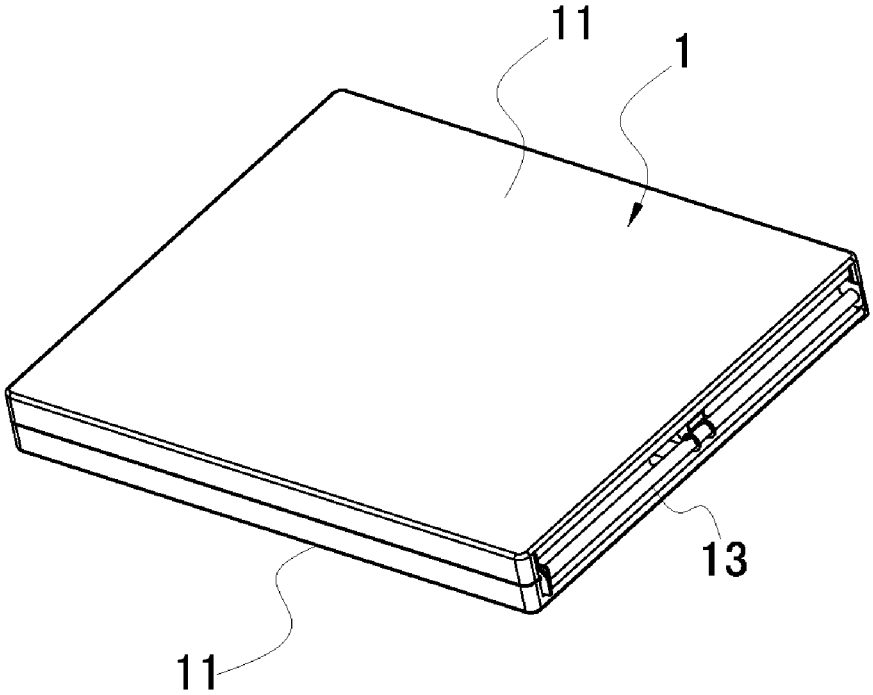
FIG. 6 is a perspective view of the folding table in a fully folded position in embodiment 1 of the present invention.

Referring to FIG. 1 the folding and unfolding process will be described with reference to the figure. The folding process is that: referring to FIG. 2. FIG. 3 and FIG. 4, the user press the block 3122 to press the elastomer 3121 and let the block 3122 release from the locking hole 3115, i.e. release the locking element 312; referring to FIG. 4 and FIG. 5, then fold the leg 2 relative to table top 1, the supporting rod will slide relative to sliding opening 3113, because the central vertical sheet 3111 is thin (the sliding 3113 has a small depth) and the sliding opening 3113 is a little larger than the section of the supporting rod 32, so the supporting rod 32 can rotate relative to sliding opening 3113, thus the leg 2 can rotate relative to table top 1, and rotate the leg 2 till it abut against the bottom of the table top 1; referring to FIG. 5 and FIG. 6, release the clamp element, fold the two vacuum-molded plastic board 11 at last. The unfolding process is that: unfold the two vacuum-molded plastic board 11, and fix the corresponding position of the two vacuum-molded plastic board 11 via the clamp element, then rotate the two leg 2 relative to the table top 1, then the supporting rod 32 will slide and rotate relative to the sliding opening 3113; when the two block 3122 of the two supporting rod 32 reach the arc surface 3114, rotate the leg 2 further, the supporting rod 32 slide relative to the sliding opening 3113 and the arc surface 3114 will abut against the block 3122 to press the elastomer 3121; at last the block 3122 move to and insert in the locking hole 3115 of the side vertical sheet 3112, the locking element 31 locked, and the position between the supporting rod 32 and locking element 31 is fixed, set the position between the sliding opening 3113 and the fixing rod 21 to make the bottom end of the supporting rod 32 abut against the top of the fixing rod 21 and the bottom end of the supporting rod 32 abut against the inner side of the sliding opening 3113, thus the position between the leg 2 and table top 1 is fixed.

According to requirement an elastomer can be set in certain position in the supporting 32, each of the two ends of the elastomer has a block 3122 which pass through the supporting rod 32 by the elasticity force. When the leg 2 abut against the bottom of the table top 1, the U-shaped sheet 311 slide to the block 3122 and the block 3122 inserted in the locking hole 3115 to lock the locking member 31 with the supporting rod 32.

According to requirement a connecter can be set in the bottom of the table top for clamp the leg 2.

Embodiment 2

Figure 10:
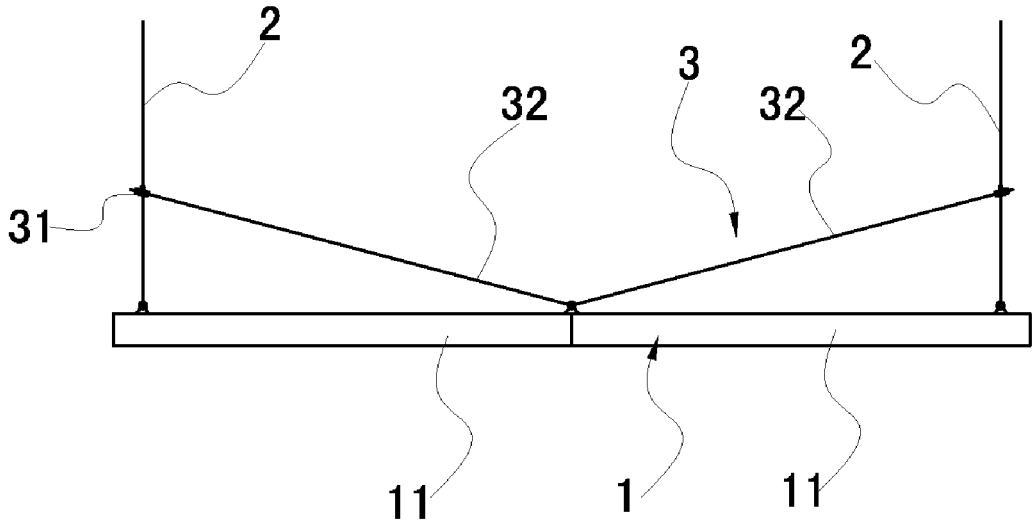
FIG. 10 illustrates the principle of the structure of the folding table in embodiment 2 of the present invention.
Figure 11:
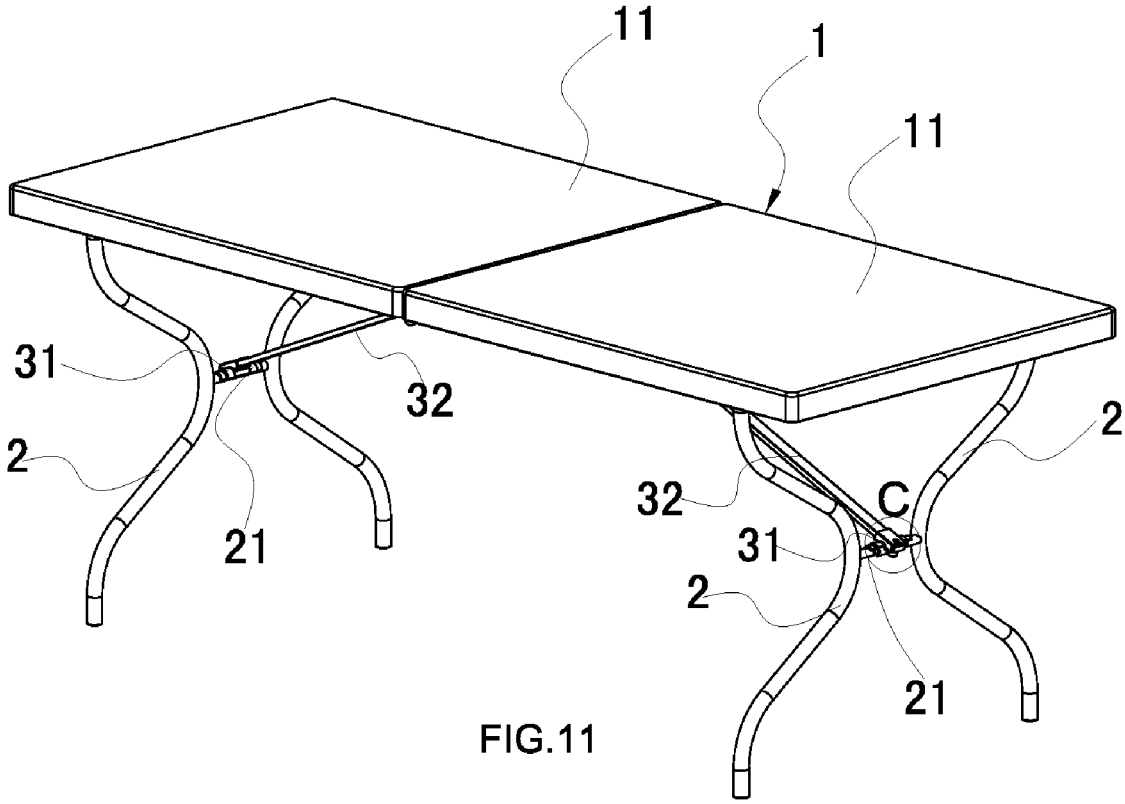
FIG. 11 is a perspective view of the folding table in an unfolded position in embodiment 2 of the present invention.
Figure 12:
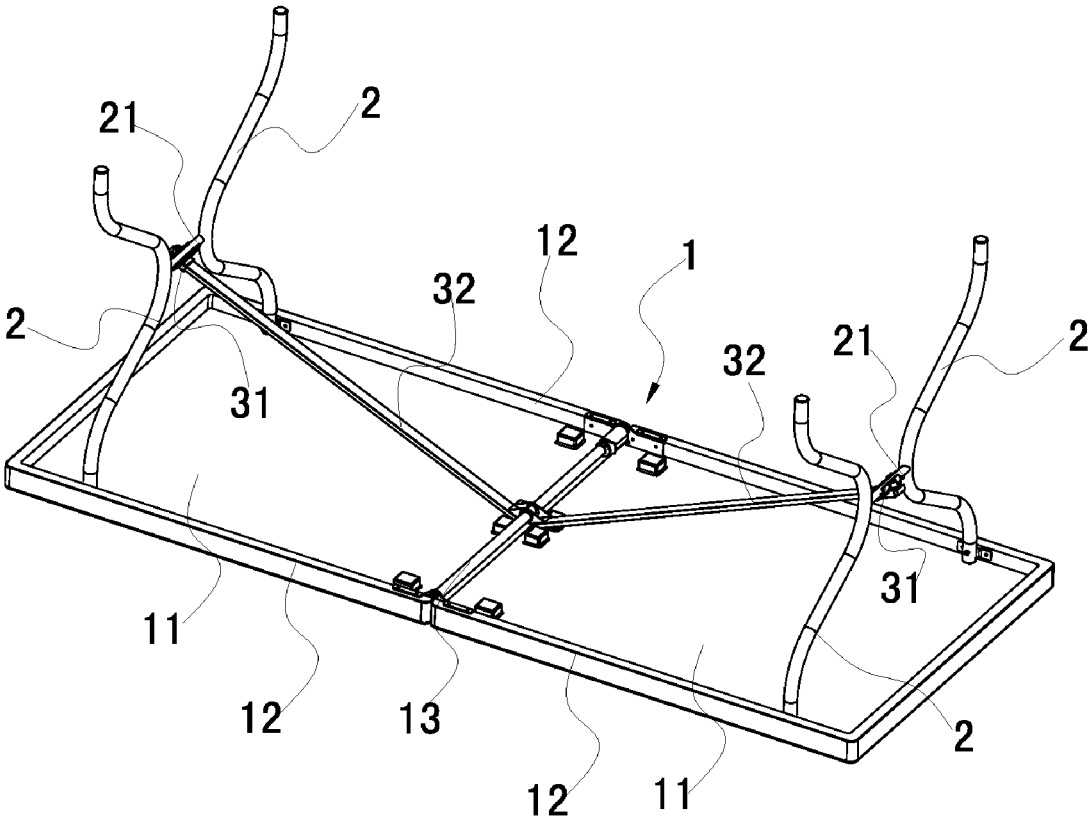
FIG. 12 is another perspective view of the folding table in an unfolded position in embodiment 2 of the present invention.
Figure 13:
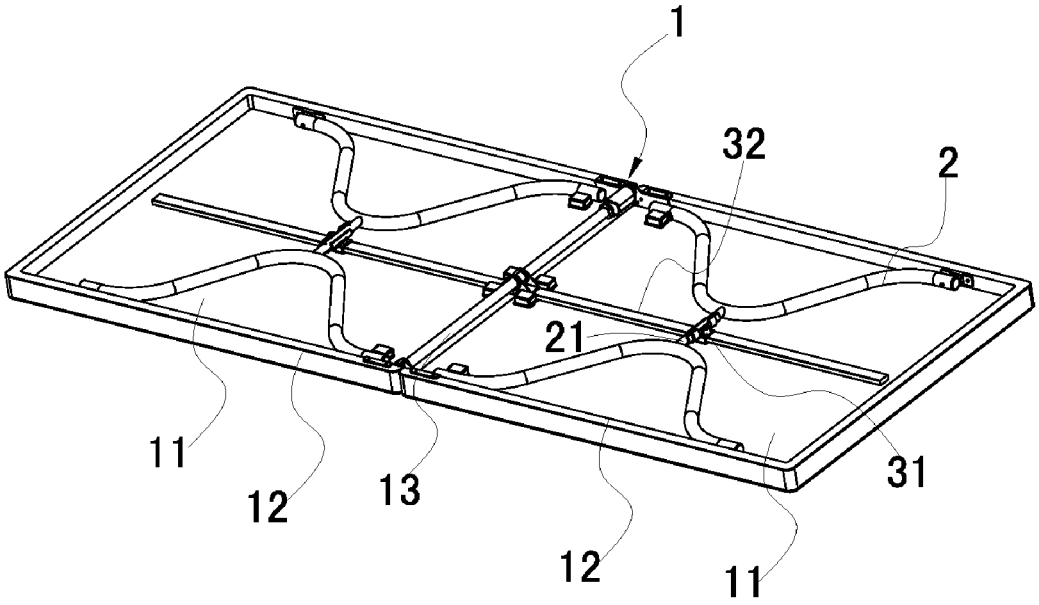
FIG. 13 is a perspective view of the folding table in a fully folded position in embodiment 2 of the present invention.
Figure 14:
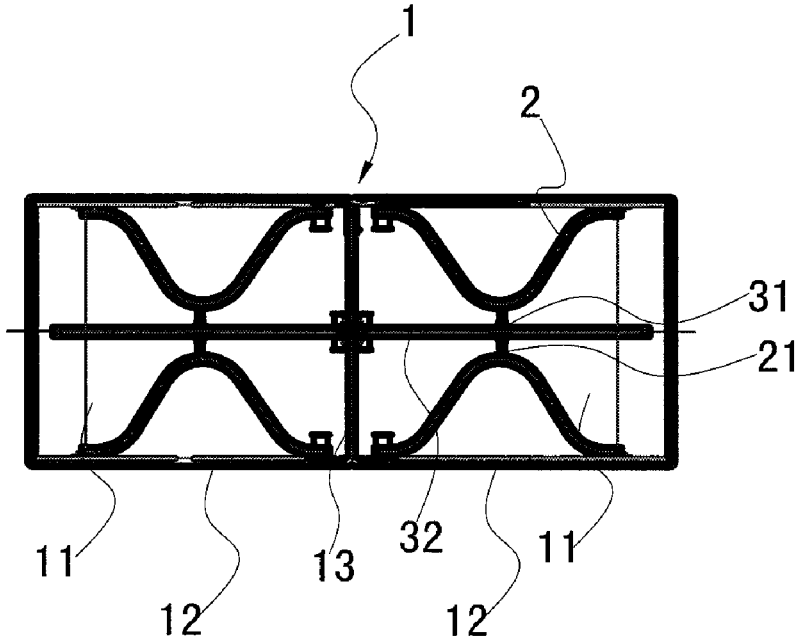
FIG. 14 is a sectional view of the folding table in a fully folded position in embodiment 2 of the present invention.
Figure 15:
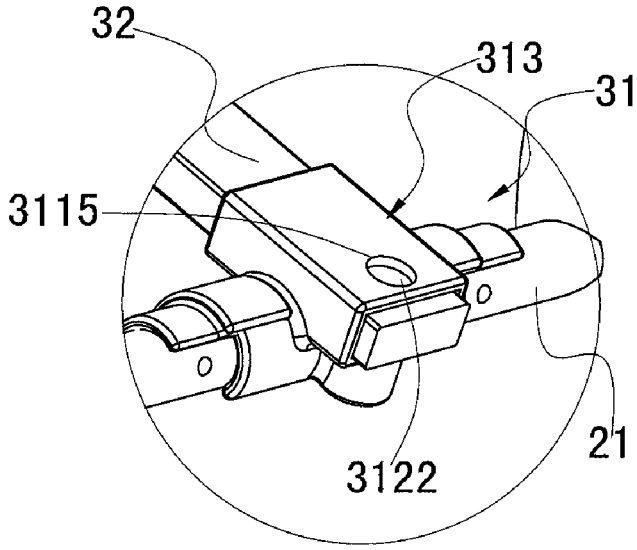
FIG. 15 is a partial enlarged view of C portion in FIG. 11.

The difference of this embodiment to embodiment 1 is that: referring to FIG. 10, FIG. 11 and FIG. 12, the supporting portion 3 comprises a supporting rod 32 and a locking member 31. The locking member 31 comprises a rotate portion, a sliding sleeve 313 and a locking element 312, the rotate portion rotatably connected to the fixing rod 21, the sliding sleeve 313 fixed to the rotate portion. Referring to FIG. 14 and FIG. 15, the sliding sleeve 313 has a locking hole 3115 which connected the inner side and the outer side of the sliding sleeve 313. the locking element 312 comprises an elastomer disposed in the supporting rod 32, a block disposed on the surface of the elastomer, the block 3122 pass through the supporting rod 32 and insert in the locking hole 3115 by the elasticity force to lock the locking member 31 with supporting rod 32. The outer portion of the block 3122 which extended out the supporting rod 32 formed a sphere for automatically lock. Referring to FIG. 10, FIG. 11, FIG. 12 and FIG. 15, the first end of the supporting rod 32 pivotally connected to the central pivot 13, the other end slidably pass through the sliding sleeve 313, then locked by locking element 312 when reach the unfolded position.

Embodiment 3

Figure 16:
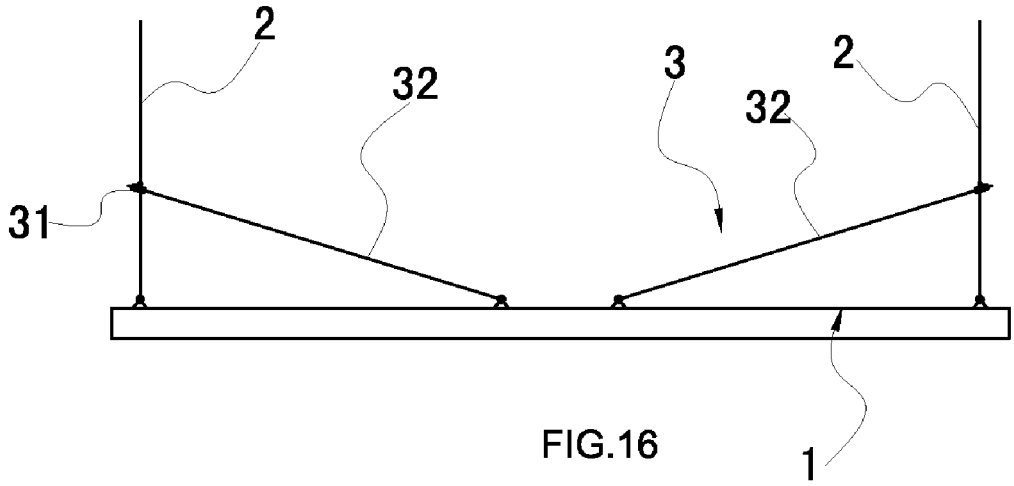
FIG. 16 illustrates the principle of the structure of the folding table in embodiment 3 of the present invention.

The difference of this embodiment to embodiment 1 is that: referring to FIG. 16, two pivots disposed in the bottom of the table top 1. the first end of the supporting rod 32 pivotally connected to the corresponding pivot 14 and the other end pass through the sliding sleeve 313, then locked by locking element 312 when reach unfolded position.

Embodiment 4

Figure 17:
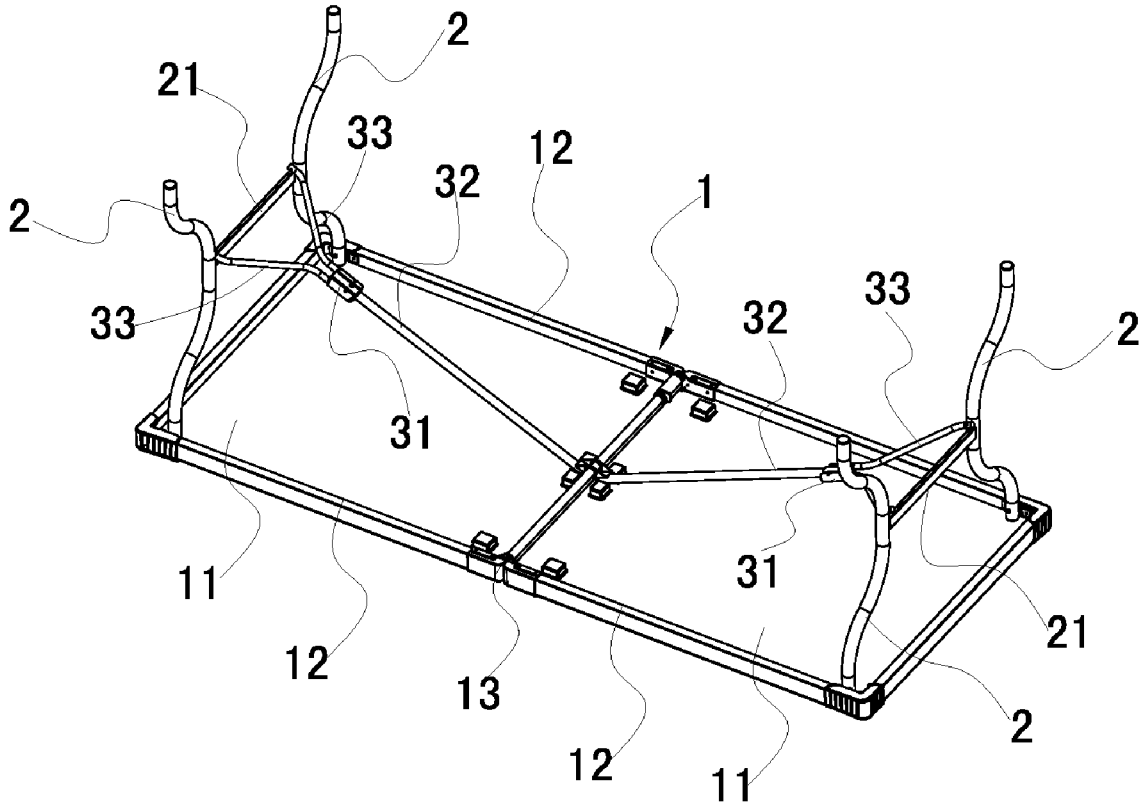
FIG. 17 is a perspective view of the folding table in an unfolded position in embodiment 4 of the present invention.
Figure 18:
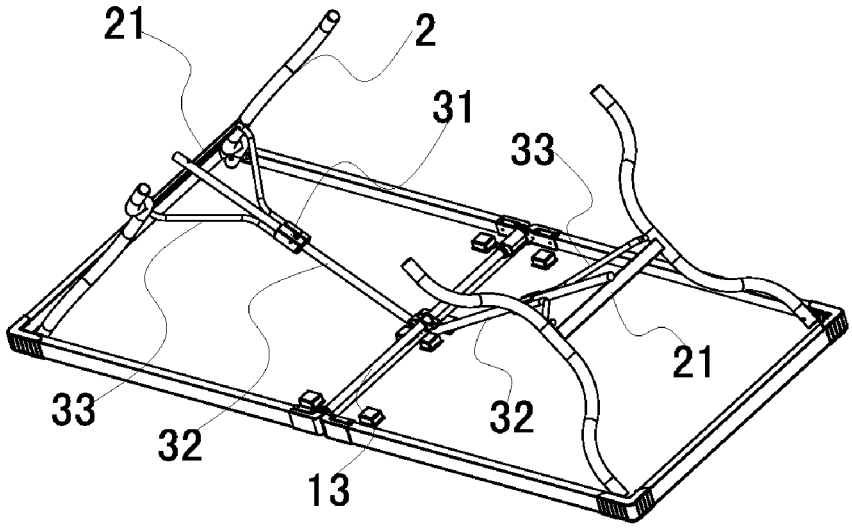
FIG. 18 is a perspective view of the folding table in a folding position in embodiment 4 of the present invention.
Figure 19:
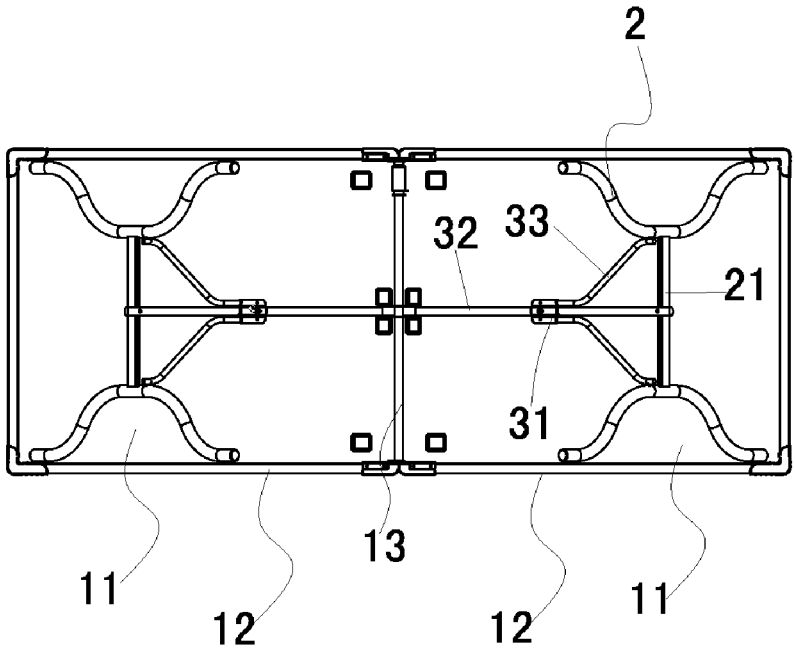
FIG. 19 is a perspective view of the folding table in another folding position in embodiment 4 of the present invention.

The difference of this embodiment to embodiment 2 is that: referring to FIG. 17, FIG. 18 and FIG. 19, the supporting portion 3 comprises a supporting rod 32, a locking member 31 and two connecting rods 33. the locking member 31 comprises a fixing portion, a sliding sleeve 313 and a locking element 312, the fixing portion fixedly connected with the sliding sleeve 313, the fixing portion comprises two holes 314 symmetrically disposed on the two sides of the sliding sleeve 313. The sliding sleeve 313 has a locking hole 3115 which connected the inner side and the outer side of the sliding sleeve 313. the locking element 312 comprises a elastomer disposed in the supporting rod 32, a block disposed on the surface of the elastomer, the block 3122 pass through the supporting rod 32 and insert in the locking hole 3115 by the elasticity force to lock the locking member 31 and supporting rod 32. the outer portion of the block 3122 which extended out the supporting rod 32 formed a sphere for automatically lock. The first ends of the two connecting rod 33 rotatably connected to the two legs 2 respectively, the two connecting rods 33 formed a V-shape. The first end of the supporting rod 32 pivotally connected to the central pivot 13, the other end slidably pass through the sliding sleeve 313, then locked by locking element 312 when reach the unfolded position.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The folding mechanism and folding table of the present invention has the following advantages: simple-structure, less rods, lower cost, stable in press, stable structure, rapid folding and unfolding, thus has good industrial applicability.

What is claimed is:

1. A folding mechanism, comprising:

a table top, a leg portion comprising two legs and a fixing rod mounted between the two legs, one end of the two legs forming a rotatable connection with the table top, and a supporting portion, comprising:

a supporting rod having a first end and a second end; and a locking member comprising a U-shaped sheet and a locking element disposed in the supporting rod; the U-shaped sheet including a central vertical sheet and two side vertical sheets, the central vertical sheet and the two side vertical sheets being fixed to the fixing rod; the central vertical sheet having a sliding opening for accommodating the supporting rod so that the supporting rod rotates relative to the sliding opening during folding and unfolding of the leg portion;

wherein the first end of said supporting rod is rotatably connected to a lower surface of the table top and the second end passes through the sliding opening; and wherein when the folding mechanism is in a locked position, the locking element in the supporting rod engages the two side vertical sheets of the U-shaped sheet fixed to the fixing rod.

2. The folding mechanism according to claim 1, wherein the supporting rod is locked at different positions relative to the locking member.

3. The folding mechanism according to claim 1, wherein the locking element comprises a longitudinal elastomer disposed in the supporting rod, wherein the longitudinal elastomer has a block at each of the ends, wherein each of the two side vertical sheets has a locking hole, and wherein the blocks pass through the supporting rod and insert in the locking holes when in the locked position.

4. A folding table, comprising:

a table top, a leg portion comprising two legs and a fixing rod mounted between the two legs, one end of the two legs forming a rotatable connection with the table top, and a supporting portion, comprising:

a supporting rod having a first end and a second end; and a locking member comprising a U-shaped sheet and a locking element disposed in the supporting rod; the U-shaped sheet including a central vertical sheet and two side vertical sheets, said central vertical sheet and the two side vertical sheets being fixed to the fixing rod; the central vertical sheet having a sliding opening for accommodating the supporting rod so that the supporting rod rotates relative to the sliding opening during folding and unfolding of the leg portion;

wherein the first end of said supporting rod is rotatably connected to a lower surface of the tabled top and the second end passes through the sliding opening; and wherein when the folding mechanism is in a locked position, the locking element in the supporting rod engages the two side vertical sheets of the U-shaped sheet fixed to the fixing rod.

5. The folding table according to claim 4, wherein the supporting rod is locked at different positions relative to the locking member.

6. The folding table according to claim 4, wherein the locking element comprises a longitudinal elastomer disposed in the supporting rod, wherein the longitudinal elastomer has a block at each of the ends, wherein each of the two side vertical sheets has a locking hole, and wherein the blocks pass through the supporting rod and insert in the locking holes when in the locked position.

* * * * *